United States Patent [19]

Ellison

[11] Patent Number: 4,930,664

[45] **Date of Patent: * Jun. 5, 1990**

[54] SELF-PRESSURIZING SPRAYER

[75] Inventor: Garry L. Ellison, Grand Rapids, Mich.

[73] Assignee: Root-Lowell Manufacturing Company, Lowell, Mich.

[ * ] Notice: The portion of the term of this patent subsequent to Nov. 8, 2005 has been disclaimed.

[21] Appl. No.: 204,625

[22] Filed: Jun. 9, 1988

Related U.S. Application Data

[63] Continuation-in-part of Ser. No. 58,519, Jun. 5, 1987, Pat. No. 4,782,982, which is a continuation-in-part of Ser. No. 3,469, Jan. 15, 1987, abandoned.

[51] Int. Cl.[5] ..... B65D 83/14

[52] U.S. Cl. ..... 222/1; 222/401; 141/18; 239/352

[58] Field of Search ..... 222/1, 396–397, 222/401, 373, 395, 478, 482; 422/266, 283; 141/18, 20, 2, 4–6, 382–383, 387; 47/1.5; 239/302, 352, 373; 137/209; 169/74.76

[56] References Cited

U.S. PATENT DOCUMENTS

| | | | |
|---|---|---|---|
| 194,597 | 8/1877 | Hearle | 222/399 |
| 1,078,028 | 11/1913 | Zeamans | 222/640 |
| 1,246,227 | 11/1917 | Bouvin | 222/394 X |
| 1,299,567 | 4/1919 | Farr | 222/395 |
| 2,501,260 | 3/1950 | Brodin | 47/1 R |
| 2,645,381 | 7/1953 | Lattman | 222/401 X |
| 2,750,752 | 6/1956 | Yorgey, Jr. | 222/397 |
| 3,109,566 | 11/1963 | Yetter | 222/394 |
| 3,245,583 | 4/1966 | Miller et al. | 222/399 |
| 3,718,165 | 2/1973 | Grothoff | 141/20 |
| 3,790,039 | 2/1974 | Zucconi | 222/394 |
| 4,431,117 | 2/1984 | Genbauffe et al. | 222/394 X |
| 4,782,982 | 11/1988 | Ellison | 222/1 |

*Primary Examiner*—Michael S. Huppert

*Attorney, Agent, or Firm*—Price, Heneveld, Cooper, DeWitt & Litton

[57] ABSTRACT

A portable sprayer which has a resealable closure, a dispensing valve and a quick disconnect one-way valve attached to a receptacle. As the receptacle is filled with fluid through the one-way valve, air which is entrapped in the receptacle pressurizes the container to facilitate dispensing the fluid. By locking the dispensing valve open or by opening the top closure of the sprayer, and securing a hose to the quick disconnect one-way valve, one can flush the sprayer out by allowing fresh water to flow continually through the system.

36 Claims, 5 Drawing Sheets

SELF-PRESSURIZING SPRAYER

CROSS REFERENCE TO RELATED APPLICATION

This is a continuation-in-part of Patent Application Ser. No. 07/058,519 filed June 5, 1987 now issued as U.S. Pat. No. 4,782,982, which in turn was a continuation-in-part of U.S. Ser. No. 07/003,469 entitled SELF-PRESSURIZING. CHEMICAL SPRAYER, filed Jan. 15, 1987, now abandoned.

BACKGROUND OF THE DISCLOSURE

This invention relates to sprayers, particularly small, portable sprayers which are often used around homes or in light industrial applications. Such sprayers and liquid dispensers require manual pressurization before the liquid therein can be dispensed. After filling to a designated line with water, a chemical solution or other liquid to be dispensed, the sprayer is pressurized by a hand pump prior to dispensing. Such hand pump pressurized sprayers have been the industry standard for small, portable sprayers for many, many years.

Such sprayers typically include a removable closure, the hand pump typically being integral with the removable disclosure. One cleans chemicals out of the inside of such sprayers by removing the closure and rinsing the container a number of times with fresh water. The container is filled or partially filled with water, then turned over to dump the water and then refilled and reemptied several times.

SUMMARY OF THE INVENTION

The sprayer of the present invention is fitted not only with valved dispensing means as is common for such sprayers, but also with a one-way filling valve adapted for connection through quick disconnect connector means to a pressurized source of the liquid to be dispensed from the sprayer whereby filling the sprayer with the liquid simultaneously serves to pressurize the sprayer. The spray dispensing valve includes locking means for locking it in an open position which permits continual flow therethrough. When a hose is connected to the quick disconnect connector and the dispensing valve is locked open, water can be continually flushed through the sprayer to thoroughly clean it either by locking the dispensing valve open or by opening a removable closure. It is not necessary to repeatedly refill and reempty the container.

These and other objects, advantages and features of the present invention will be more fully understood and appreciated by reference to the written specification and appended drawings.

BRIEF DESCRIPTION OF THE DRAWINGS

Preferred embodiments of the invention have been depicted for illustrative purposes wherein.

DESCRIPTION OF THE PREFERRED EMBODIMENT

Figure 1:
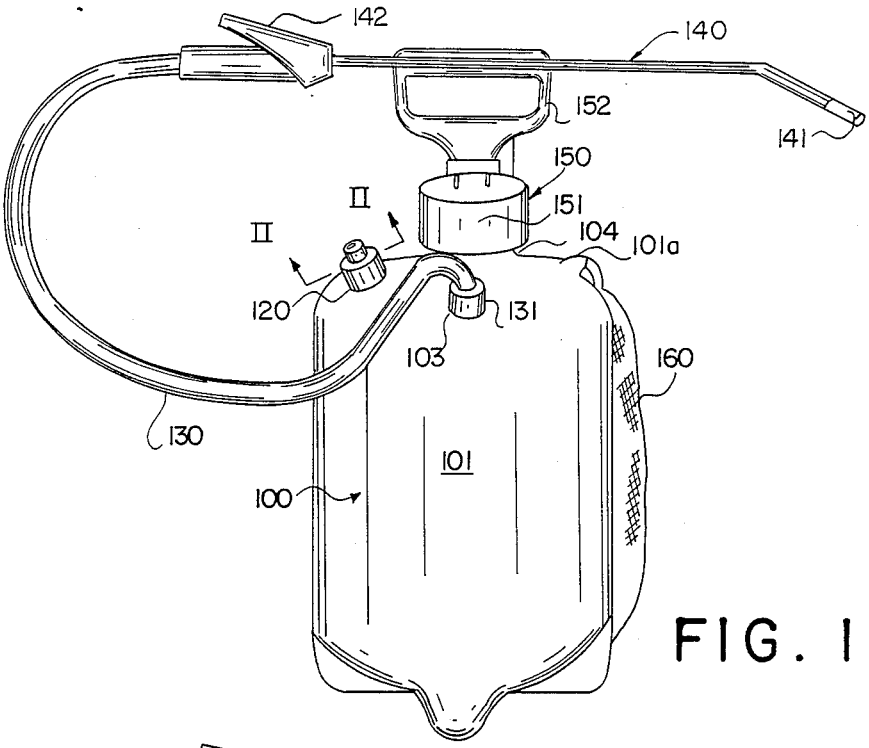
FIG. 1 is a perspective view of a sprayer made in accordance with the present invention.
Figure 2:
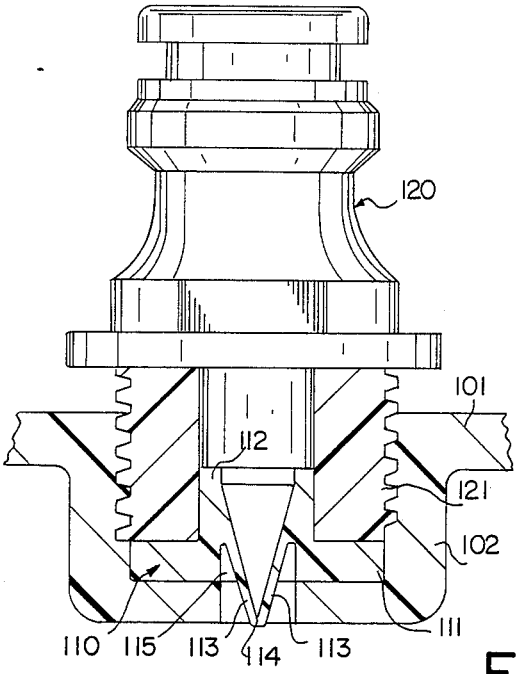
FIG. 2 is a fragmentary, cross-sectional view taken generally along plane II—II of FIG. 1.

The preferred embodiment herein described is not intended to be exhaustive or to limit the invention to the precise form disclosed. It is chosen and described to illustrate the principles of the invention and its application and practical use to thereby enable others skilled in the art to utilize the invention In the preferred embodiment, sprayer 100 (FIG. 1) comprises a molded plastic container 101, preferably molded of polyethylene, which includes an integrally molded, threaded valve seat 102 for receiving a one-way valve assembly including one-way valve 110 and a quick disconnect hose coupler 120 (FIGS. 1 and 2). Container 101 also includes an integrally molded outlet fitting 103 to which delivery tube 130 is secured and an integrally molded threaded top opening 104 upon which the closure and hand pump assembly 150 is threadably mounted (FIGS. 1 and 2). Container 101 is filled by quick connecting a garden hose to quick disconnect hose coupler 120 and allowing water to flow therein. A dispensing wand 140 including a dispensing valve 142 is secured to the end of delivery tube 130. When dispensing valve 142 is in its closed condition, water flowing into plastic container 101 pressurizes the container without the need for using hand pump assembly 150.

One-way valve 110 is made of a flexible rubber and comprises an annular shoulder 111 which surrounds and projects radially outwardly from a central, cylindrical body 112. Cylindrical body 112 projects in one direction away from shoulder 111 defining a relatively large inlet opening and then terminates in a duck bill flap arrangement 113 at approximately its juncture with that side of annular shoulder 111 from which it projects. Duct bill flaps 113 define a slit opening 114 therebetween where they come together. The cross-section of converging flexible rubber walls 113 is sufficiently thin that they will flex apart slightly to allow fluid to flow therethrough in one direction, but will be compressed together so as to close slit 114 under back pressure within container 101. There is an annular recess 115 in shoulder 110 which surrounds duck bill flaps 113, thereby giving them additional flexibility for proper closure against the movement of fluids in the wrong direction through slit opening 114.

Duck bill valve 110 is seated within the recess defined by valve seat 102 and is held in position by threading hose coupler 120 into the integrally formed threads in valve seat 102. The threaded, cylindrical end 121 of quick disconnect hose coupling 120 seats on top of shoulder 111 of valve 110 and thereby traps it in position against the base wall of valve seat 102.

Figure 3:
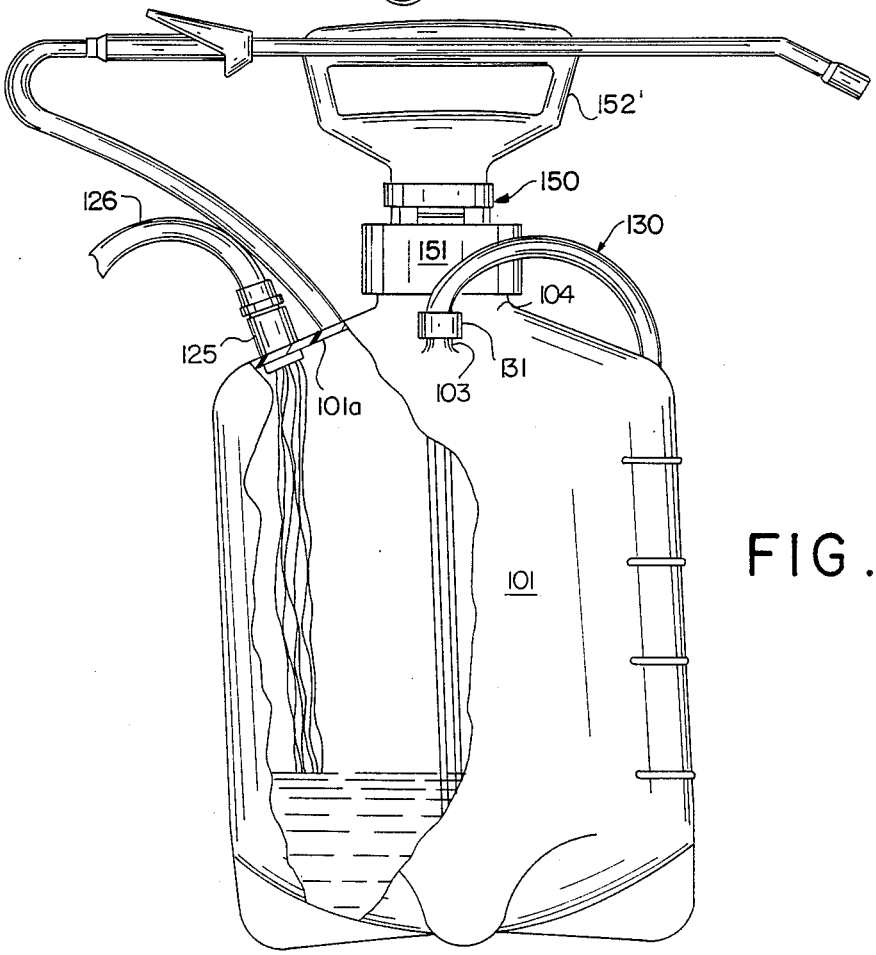
FIG. 3 is a partially broken view of the FIG. 1 sprayer being filled with liquid under pressure.

Quick disconnect hose coupler 120 is of a conventional quick disconnect configuration. It is adapted for quick disconnect mating to a quick disconnect coupler 125 which can be threaded onto the end of a conventional garden hose or the like 126 (FIG. 3).

Preferably, one-way valve 110 and hose coupler assembly 120 are positioned in the top wall 101*a* of container 101. This makes it easier to connect hose 126 via coupling 125 in that one can press downwardly against coupler 120 while container 101 is resting on the ground or other firm surface. If coupler 120 were located in the side of container 101, the user would have to hold container 101 against movement while pressing hose 126 and coupling 125 onto coupler 120.

A flexible delivery tube 130 is clamped over integrally molded outlet fitting 103 by means of a tube clamp 131. The other end of flexible delivery tube 130 is secured to a spray wand 140 which includes a spray nozzle 141 at one end and a valve assembly 142 at the other end.

In the preferred embodiment, valve assembly 142 includes means for locking the valve in an open condition. In the preferred embodiment, the locking means locks open a dispensing valve which is normally biased closed. However in the broader aspects of the invention, the term is also intended to encompass any type of valve whereby once the valve is opened, it cannot be closed without physical manipulation by the user. Thus in the broadest aspects of the invention, a simple ball valve manipulated by an on-off lever would comprise a valve including means for locking the valve in an open condition. In such an alternative example, the means for locking the valve in the open condition would be the lever used to turn the valve to its open position.

While such a feature is conventional per se, it offers synergistic advantages in the combination of the present invention. Specifically, the combination of valve assembly 142 which can be locked in an open condition and quick disconnect hose coupler 120 on one-way valve 110 greatly facilitates cleaning a sprayer incorporating the present invention. Specifically, one can connect a hose via quick disconnect coupler 125 to quick disconnect coupler 120 and simultaneously lock valve assembly 142 in its open condition, thereby allowing water to flush continuously through sprayer 100.

Valve 142 includes a valve body 406 (FIGS. 7, 8, 9 and 10), having a hollow interior 408 for receiving valve pin 410. Valve pin 410 comprises a hollow cylindrical sleeve 411 extending from an enlarged valve head 418. Valve pin 410 is slidably received in hollow interior 408, with spring 414 located around the outside thereof, and is threadably connected to valve pin nut 416 such that valve head 418 is spring biased against 0-ring 426 which is seated against the end of valve body 406. Valve body 406 and nut 416 include annularly grooved shoulders 420 and 422, respectively, against and within which spring 414 is seated. The end of dispensing wand 140 is located within the interior of sleeve 411 such that as valve pin 410 is threaded into pin nut 416, it grips the end of wand 140 to secure wand 140 in place.

Fluid is directed to valve pin head 418 via hollow handle 404 which is threadably secured to the end of valve body 406. The interior of handle 404 is enlarged at 405, in the vicinity of head 418. Valve pin 410 includes an input aperture 424 in the sidewall of sleeve 411 allowing for communication of fluid through the interior of sleeve 411 when valve pin 410 is disposed in an open position.

Normally the valve head 418 is spring biased against O-ring 426 so that no fluid can communicate with input aperture 424. Movement of valve pin 410 rearwardly (to the right in FIGS. 7–10), unseats valve pin head 418 from O-ring 426 and allows fluid to flow through the enlarged portion 405 of handle 404, through opening 424 in the sidewall of hollow sleeve 411, and through wand 140. Such movement of valve pin 410 is facilitated by flow control lever 402 pivotally mounted at holes 430 in the shroud-like forward portion thereof, which fit over pins 433 projecting from either side of valve body 406. Lever 402 includes a front shoulder portion 436 which abuts the end of valve pin nut 416 so that as lever 402 is depressed, the rearward movement of shoulder 436 forces valve pin nut 416 and consequently valve pin 410 rearwardly. This unseating of valve pin head 418 from O-ring 426 opens valve 142 for the flow of liquid therethrough.

Figure 10:
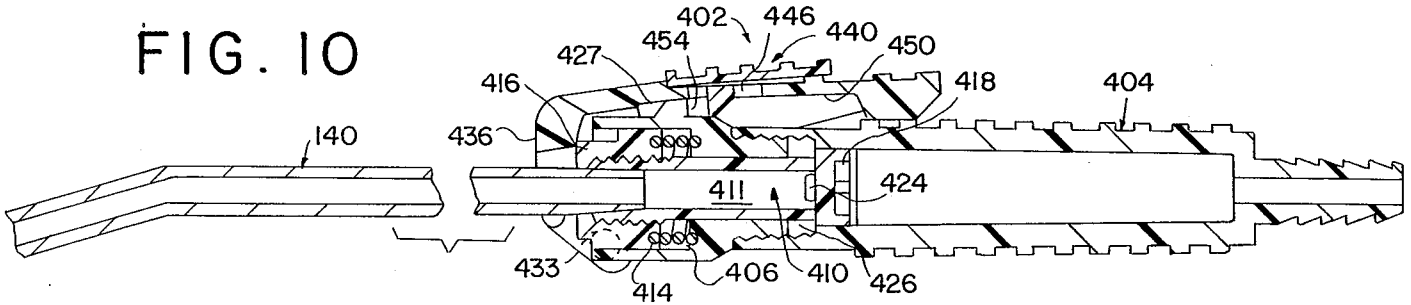
FIG. 10 is the same view as FIG. 9 but with the flow control lever of the dispensing valve being locked in its valve opening position.
Figure 7:
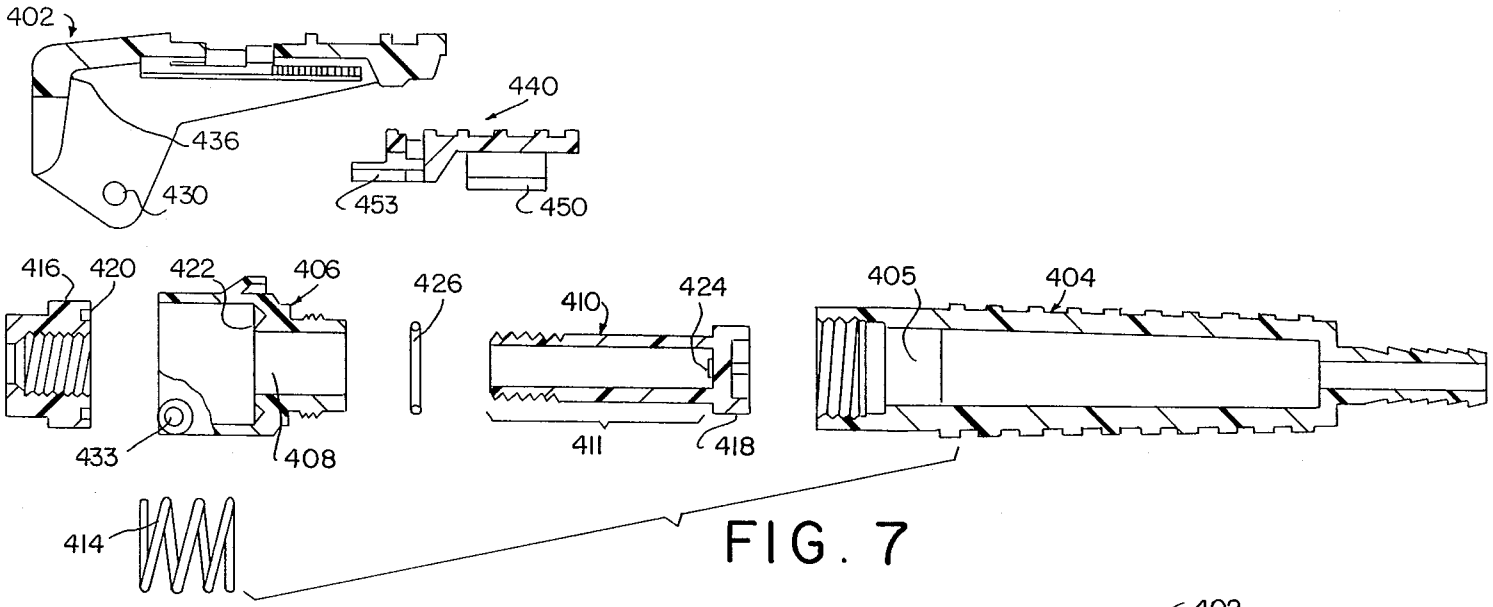
FIG. 7 is an exploded cross-sectional view of the major components of the dispensing valve of the sprayer.
Figure 11:
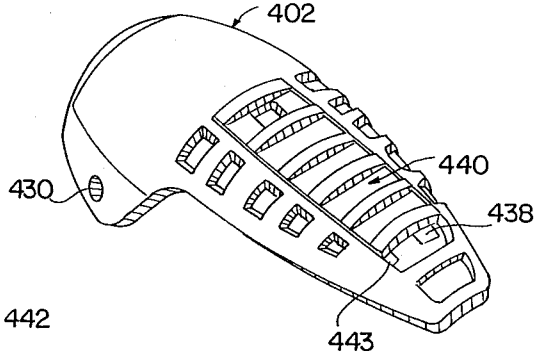
FIG. 11 is a perspective view of the dispensing valve lever looking down on the top thereof.
Figure 12:
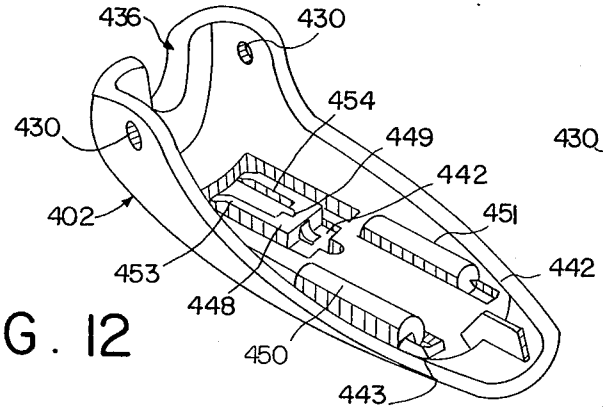
FIG. 12 is a perspective view of the dispensing valve lever with the lever inverted from its position as shown in FIG. 1.

As best illustrated in FIGS. 11 and 12, lever 402 includes a recess 438 for slidably receiving a thumb lock 440. Disposed within the recess 438 are spaced, parallel longitudinal slots 443 and 444 for receiving the downwardly projecting and outwardly curving flanges 450 and 451 of thumb lock 440. Thumb lock 440 includes a lower jaw 448, from which retainer prongs 453 and 454 project. Retainer prongs 453 and 454 slide under the forward shroud portion of lever 402 to hold thumb lock 440 slidably in position within recess 438. Lower jaw 448 includes a centrally located, front opening, vertical slot 449 therein. When lever 402 is in its depressed position, thumb lock 440 can be slide forwardly until the lower jaw 448, slides under a detent 427 which protrudes upwardly from the top of valve body 406. Detent 427 is T-shaped in cross-section so that lower jaw 448 slides under the "T" cross bar with slot 449 accommodating the "T" stem. This serves to hold lever 402 down and holds valve 142 open so that liquid flows continually therethrough (FIG. 10).

A conventional hand pump assembly 150 including a threaded closure 151 is threaded over the threaded top opening 104 of container 101. Pump handle 152 includes an elongated groove integrally formed therein so that wand 140 can be seated in the groove for storage and transport. Handle 152 can be released for pumping to facilitate hand pressurization of container 101, or it can be locked in a down position to serve as a carrying handle for sprayer 100. Sprayer 100 can also be carried by the user over his shoulder by means of a carrying strap 160 suitably fastened to container 101.

Hand pump assembly 150 serves not only as a closure for receptacle 101, but also makes it possible to repressurize receptacle 101 when the user is remote from the source of liquid under pressure which is being used. Thus a homeowner spraying chemicals on his lawn might be at a remote location from the hose and still have some chemical solution remaining in container 101. He can simply use hand pump 150 to repressurize receptacle 101 and finish using the solution therewithin.

To pressurize container 101 of sprayer 100, a hose 126 connected to a pressurized source of the liquid to be sprayed is coupled to quick disconnect coupler 120 by means of its mating quick disconnect coupler 125. Coupler 125 is preferably of the conventional type which automatically allows the fluid under pressure to pass when it is coupled to coupling 120. If the fluid is water and one desires to spray a solution of chemicals, the chemicals are first introduced into container 101 through top opening 104 by simply unthreading top closure 151 and removing pump/handle assembly 150. With the solid or liquid chemicals introduced into container 101, closure 151 is again threaded onto threaded top opening 104 and hose 126 is coupled as described above.

There are two alternative methods in accordance with the present invention for cleaning the container after it has been used with chemical solutions. Both methods involve coupling a hose from the water source to the container 101 by coupling quick disconnect hose fitting 125 to quick disconnect hose coupler 120 on container 101. In one method, dispensing valve 142 is locked in its open condition, thereby allowing water to flush continuously through sprayer 100. In the other method, closure 150 is removed from container 101 and water is allowed to flush continually through container 101 and out through the open top thereof.

Typically, container 101 will be filled with water coupled to a house or industrial water system. Usually, the pressure of such water is a fairly predictable 60 to 70 psi. However for use in conjunction with higher pressure systems or systems where the pressure may fluctuate, an alternative embodiment, automatic shut off valve assembly 200 is provided (FIGS. 4 and 5) in place of one-way valve 110 and hose coupler 120. In this embodiment, the integrally molded valve seat 102 of container 101 does not include internal threads. Rather, it includes an upwardly projecting, integrally molded sleeve **102*a* having integrally molded external threads upon which can be threaded a valve closure cap 201. Valve closure cap 201 includes a central opening which telescopingly receives a hose coupling stem 202, which includes a central fluid flow passage 203. Passage 203 terminates at the bottom in a lateral passage 204 which in turn feeds into an annular passage 205 around the base of coupling stem 202. Annular passage 205 is defined by a pair of annular shoulders 206 projecting from the base of coupling stem 202 on either side of annular passage 205. Each annular shoulder 206 and 207 includes a groove formed therein for receiving top and bottom O-rings 208 and 209** respectively.

Positioned between telescoping coupling stem 202 and the interior wall of externally threaded sleeve **102*a* is a sleeve 210 having an outwardly radiating top flange 211 which seats on the top edge of threaded sleeve 102*a* and is held in place by top threaded closure 201. Sleeve 210 includes a plurality of vertical grooves or passages 212 which extend from the bottom of sleeve 210 upwardly a portion of the distance towards the top thereof. When telescoping coupling 202 is in the position shown in FIG. 4, annular passage 205 is in flow communication with vertical groove passages 212. This allows fluid under pressure to flow in through central passage 203, lateral passage 204, annular passage 205 and downwardly through vertical passageways 212 into the space below telescoping coupling stem 202. From thence fluid can flow through the opened top of a one-way duck bill valve 110*a* which is very similar to duck bill valve 110 previously described. One-way duck bill valve 110*a* is held in position by means of a washer 230 seated over shoulder flange 111 of valve 110*a* and held down by the lower terminal end of sleeve 210. Washer 230 includes upwardly projecting dimples 231 which insure that there will be a fluid flow passage between the bottom of telescoping stem 202 and the top of washer 230 even when telescoping stem 202 is in its bottommost position as shown in FIG. 4, thereby allowing fluid to flow over washer 230 and into the opened top of duck bill valve 110*a***.

Figure 4:
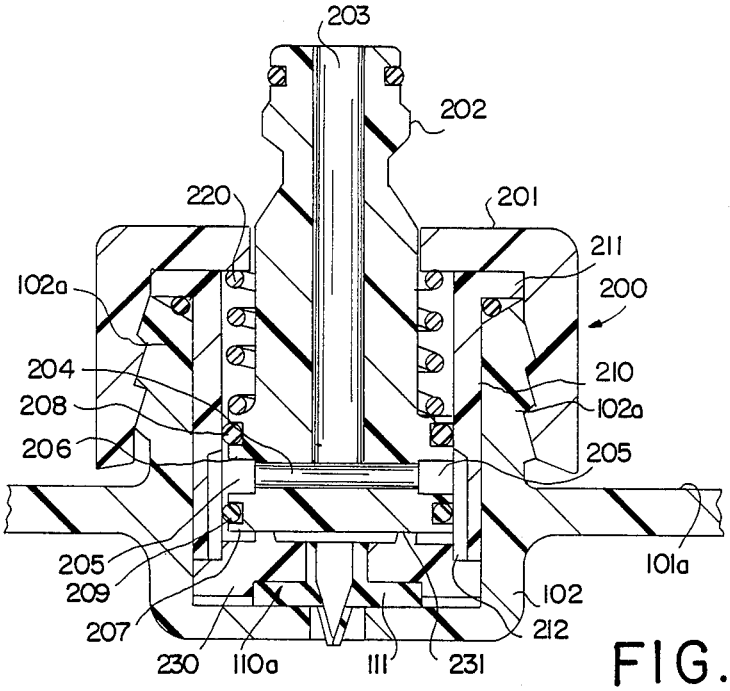
FIG. 4 is a cross-sectional view of an alternative embodiment fill valve.
Figure 5:
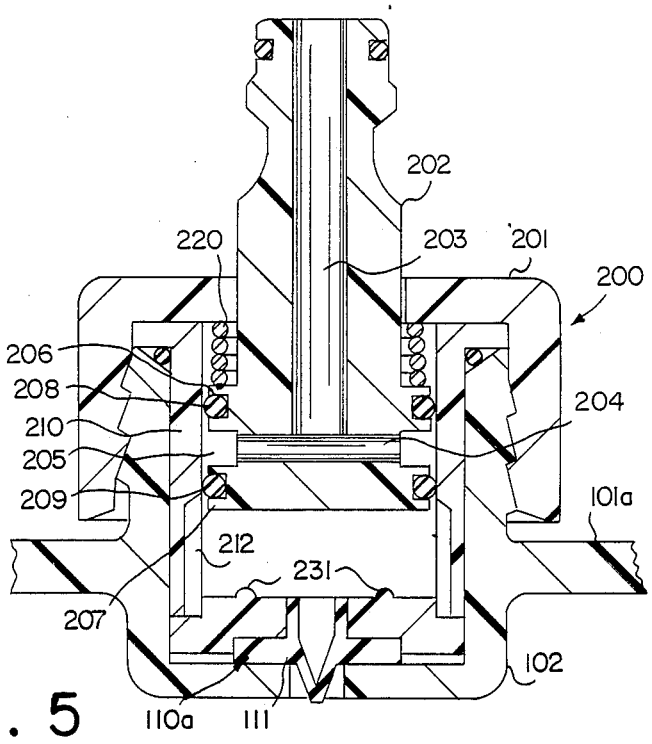
FIG. 5 is a cross-sectional view of the valve of FIG. 4 after a predetermined pressure level has been achieved within the sprayer.

Coupling stem 202 is biased downwardly into the position illustrated in FIG. 4 by means of a coil spring 220 extending between the undersurface of the top of closure 201 and the upper surface of upper annular shoulder 206. However when back pressure begins to build up at the base of telescoping coupling stem 202, stem 202 is forced upwardly until, when it is in the position illustrated in FIG. 5, annular passage 205 is sealed from vertical groove passages 212 by means of the bottom O-ring 209 in bottom annular shoulder 207. This prevents any further flow of fluid into container 101 and prevents container 101 from being overpressurized. Typically, coil spring 220 will be selected such that a back pressure of between 70 and 80 pounds will close valve assembly 200 and prevent further pressurization of container 101.

Figure 6:
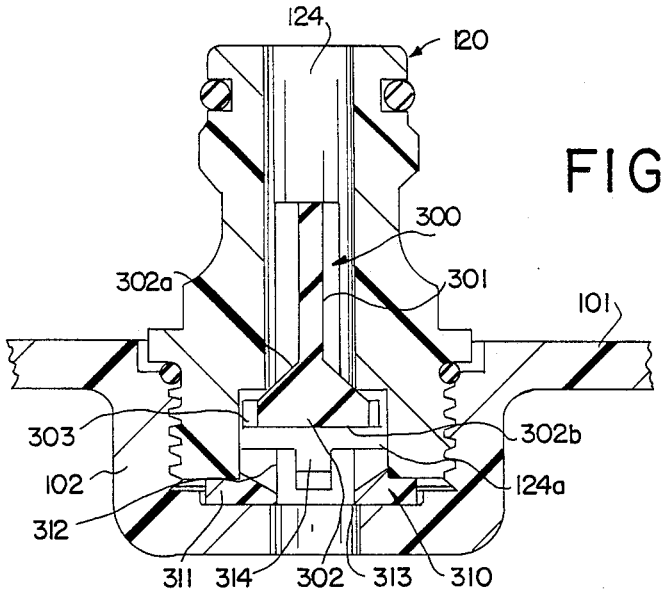
Fig. 6 is a cross-sectional view of yet another alternative embodiment fill valve for use in the present invention.
Figure 8:
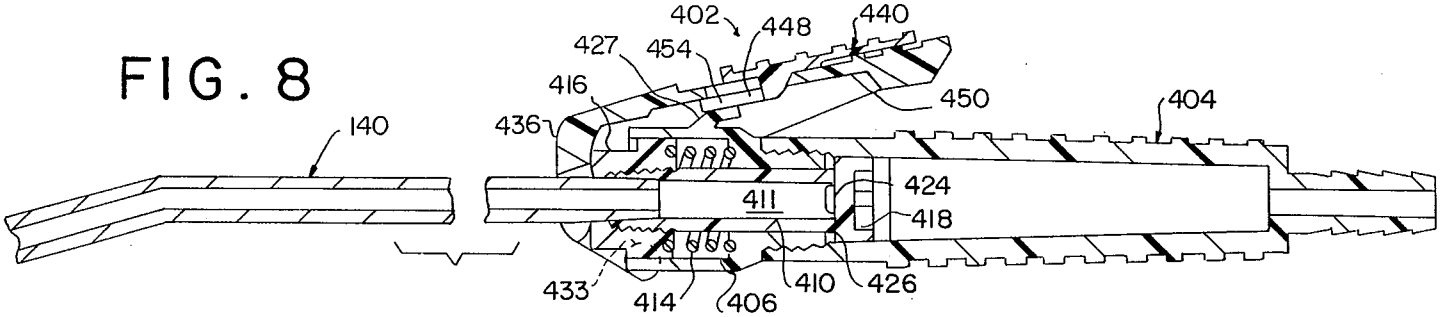
FIG. 8 is a cross-sectional view of the dispensing valve of the sprayer in its normally closed condition.
Figure 9:
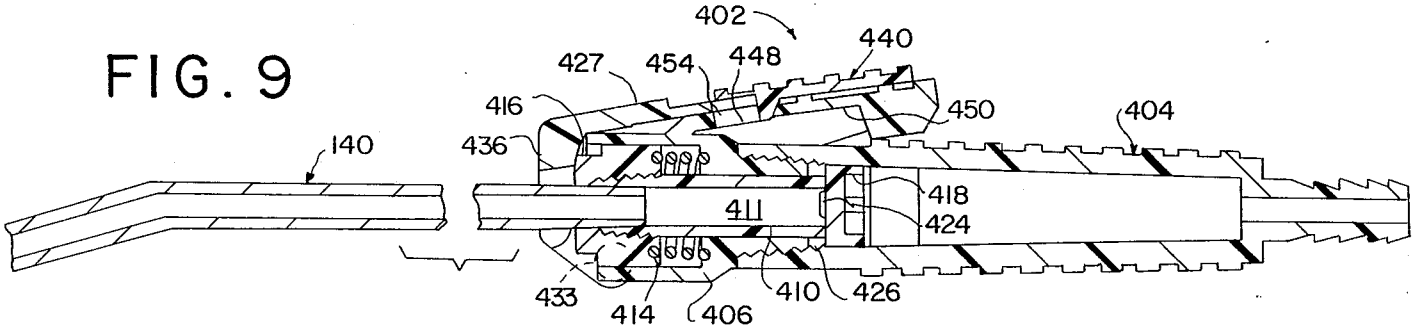
FIG. 9 is the same cross-sectional view, but with the valve in its opened condition.

FIG. 6 illustrates a one-way valve alternative to the use of duck bill valve 110 or **110*a* which alternative is currently believed to be the best mode one-way valve for use in the present invention. Basically, duck bill valve 110 is replaced by a poppet valve 300 combined with a flow maintaining valve stop 310. Poppet valve 300 is axially movably received within the internal passageway 124 of hose coupler 120 and flow maintaining valve stop 310 is held in place in the base of valve seat 102 by hose coupling 120 being threaded into valve seat 102 over valve stop 310**.

Poppet 300 includes a stem 301 comprised of intersecting flanges, giving it a X-shaped cross-section which keeps poppet 300 properly oriented as it moves within passageway 124, but still allows water to flow around stem 301. It is made of rubber with a Shore A durometer of 65–90, preferably 80±5.

Stem 301 is connected to the valve head 302 which includes a cone-shaped upper surface 302 defining a valve seat. Head 302 is larger in diameter than the base of passageway 124 so that it seats on the base of passageway 124 and blocks the flow of liquid or air therethrough.

The base of passageway 124 opens into a larger chamber **124*a* at the base of hose coupler 120. Poppet head 302 is larger in diameter than passageway 124, but is not as large in diameter as the internal diameter of chamber 124*a*. Ribs 303 project radially from the perimeter of head 302 to help keep poppet 300 centered by their engagement with the walls of chamber 124*a*, without blocking the flow of fluid around head 302**.

Head 302 includes a flat bottom **302*b* which, when one connects hose coupler 120 to a source of fluid under pressure, gets forced down and seats on top of valve stop 310**.

Valve stop 310 comprises basically a shoulder washer having an annular projecting shoulder 311 projecting radially from a main cylindrical body 312 which includes a central opening 313 extending therethrough in alignment with the opening in the base of valve seat 102. A plurality of radial channels 314 are cut into the top of the main cylindrical body 312 and communicate with central opening 313 so that even when the bottom **302*b*** of valve head 302 is seated on top of valve stop 310, water can flow around valve head 302, past radiating ribs 303, through channels 314 and into passageway 313, thereby allowing fluid to flow into the interior of container 101. On the other hand once container 101 is pressurized and the source of pressurized fluid is uncoupled from hose coupler 120, pressure within container 101 will push poppet 300 upwardly so that the conical upper surface 302*a* of its head 302 seats against the base of coupler passageway 124, thereby preventing the flow of air or liquid back around valve head 302 to the exterior of container 101.

Of course, it is understood that the above is merely a preferred embodiment of the invention and that various changes and alterations can be made without departing from the spirit and broader aspects thereof.

The embodiments of the invention in which an exclusive property or privilege is claimed are defined as follows:

1. A portable sprayer for dispensing water or water solutions under pressure, comprising:

a closed receptacle for containing water or water solutions under pressure, said receptacle including a dispensing outlet operably connected to dispensing valve means which can be opened to dispense water or water solutions under pressure or closed to seal said container;

a one-way valve extending from outwardly of said receptacle to inside the receptacle, said one-way valve including a quick disconnect fitting operably connected thereto for connection to a source of water under pressure and comprising means for allowing entry of water or water solutions into said receptacle while preventing back flow out of said receptacle, whereby said receptacle is pressurized during entry of water into said receptacle when said dispensing valve means is closed;

said dispensing valve means including lock means for locking said dispensing valve means into an open position whereby one can clean the interior of said sprayer by connecting a source of water under pressure to said quick disconnect connector of said one-way valve and locking said dispensing valve open to allow cleaning water to continually flush through said sprayer.

2. The portable sprayer of claim 1 in which said dispensing valve means is normally biased into a closed position.

3. A portable sprayer of claim 2 in which said dispensing valve includes a valve body, a valve member movably mounted in said body and a flow control lever pivotally mounted on said valve body and operably connected to said valve member to move same between closed and opened positions;

said valve member being normally biased into a closed position;

said flow control lever being pivotally movable towards said valve body to move said valve member to its open position;

said flow control lever including a locking element slidably mounted therein and including a jaw for engaging a detent protruding from the surface of said valve body whereby said flow control lever can be locked against said valve body and said valve member thereby locked in its open position.

4. The sprayer of claim 1 in which said container includes a bottom, a sidewall and a top wall, said one-way valve, including said quick disconnect fitting, being located in said top wall whereby one can connect a quick disconnect hose coupling to said quick disconnect fitting by pressing downwardly with said receptacle being seated on a firm surface.

5. The portable sprayer of claim 4 in which said receptacle includes a resealable closure which can be opened to allow the insertion of chemicals into said container and reclosed and resealed to allow pressurization through the introduction of water under pressure:

said resealable closure being located in said top wall separately from said quick disconnect fitting.

6. The sprayer of claim 5 which additionally includes hand pump means mounted in said resealable closure whereby said sprayer can alternatively be pressurized by means of said hand pump means.

7. A method for cleaning the interior of a portable sprayer which comprises:

providing said sprayer with a one-way valve communicating with the sprayer interior and including a quick disconnect fitting operably connected thereto whereby a source of water under pressure can be readily quick connected to said quick disconnect fitting;

providing said portable sprayer with a sprayer outlet including a dispensing valve which includes means for locking said dispensing valve in an open position;

quick connecting a hose from a source of water to said quick disconnect fitting of said one-way valve, locking said dispensing valve in an open position and allowing water to flush continuously through said sprayer, whereby said sprayer can be readily flushed clean.

8. The method of claim 7 in which said step of providing said portable sprayer with a sprayer outlet including a dispensing valve includes providing a dispensing valve which is normally biased into a closed position.

9. The method of claim 8 in which said dispensing valve includes a valve body, a valve member movably mounted in said body and a flow control lever pivotally mounted on said valve body and operably connected to said valve member to move same between closed and opened positions;

said valve member being normally biased into a closed position;

said flow control lever being pivotally movable towards said valve body to move said valve member to its open position;

said flow control lever including a locking element slidably mounted therein and including a jaw for engaging a detent protruding from the surface of said valve body whereby said flow control lever can be locked against said valve body and said valve member thereby locked in its open position.

10. The method of claim 7 in which said container includes a bottom, a sidewall and a top wall, said one-way valve, including said quick disconnect fitting, being located in said top wall whereby one can connect a quick disconnect hose coupling to said quick disconnect fitting by pressing downwardly with said receptacle being seated on a firm surface.

11. The method of claim 10 in which said receptacle includes a resealable closure which can be opened to allow the insertion of chemicals into said container and reclosed and resealed to allow pressurization through the introduction of water under pressure;

said resealable closure being located in said top wall separately from said quick disconnect fitting.

12. The method of claim 11 which additionally includes hand pump means mounted in said resealable closure whereby said sprayer can alternatively be pressurized by means of said hand pump means.

13. A method for cleaning the interior of a portable sprayer which comprises:

providing said sprayer with a one-way valve communicating with the sprayer interior and including a quick disconnect fitting operably connected thereto whereby a source of water under pressure can be readily quick connected to said quick disconnect fitting;

providing said portable sprayer with a sprayer outlet including a dispensing valve;

providing said portable sprayer with an open top having a removable closure, whereby said open top can be sealed by said closure to facilitate pressurization of said container, and whereby said closure can be removed from said open top;

removing said closure from said open top and quick connecting a hose from a source of water to said quick disconnect fitting of said one-way valve, and allowing water to flush continuously through said sprayer whereby said sprayer can be readily flushed clean.

14. In a portable sprayer for dispensing liquids under pressure, said sprayer comprising a closed receptacle for containing liquids under pressure, said receptacle including a dispensing outlet operably connected to dispensing valve means which can be opened to dispense liquid under pressure or closed to seal said container;

said receptacle including a resealable closure which can be opened to allow the insertion of chemicals into said container and then reclosed and resealed to allow pressurization through the introduction of liquid under pressure; and a one-way valve means separate from said dispensing outlet and dispensing valve means and having a first end extending outwardly of said receptacle and communicating with the exterior of said receptacle, said first end having a first disconnect fitting thereon;

said one-way valve having a second end communicating directly with the inside of said receptacle and a one-way valve element for permitting the flow of liquid only into said receptacle and preventing backflow out of said receptacle;

said first disconnect fitting being adapted for mating engagement with a second disconnect fitting in flow communication with a source of liquid under pressure;

said one-way valve means allowing entry of said liquid directly into said receptacle from said source of liquid under pressure through said one-way valve element only while said first and second disconnect fittings are engaged and while liquid is flowing through said first disconnect fitting, whereby said receptacle is pressurized during the direct entry of said liquid into said receptacle when said dispensing valve means is closed and said resealable closure is closed;

said one-way valve element preventing backflow of said liquid out of said receptacle.

15. The portable sprayer of claim 14 in which said first and second disconnect fittings comprise first and second quick disconnect fittings.

16. The portable sprayer of claim 15 which additionally includes hand pump means whereby said sprayer can alternatively be pressurized by means of said hand pump means.

17. In a portable sprayer for dispensing liquids under pressure, said sprayer comprising a closed receptacle for containing liquids under pressure, said receptacle including:

a dispensing outlet operably connected to dispensing valve means which can be opened to dispense liquid under pressure or closed to seal said container;

said container including a bottom, a sidewall and a top wall;

a one-way valve means located in said top wall separate from said dispensing outlet and dispensing valve means and having a first end extending outwardly of said receptacle and communicating with the exterior of said receptacle, said first end having a first disconnect fitting thereon;

said one-way valve having a second end communicating directly with the inside of said receptacle and a one-way valve element for permitting the flow of liquid only into said receptacle and preventing backflow out of said receptacle;

said first disconnect fitting being adapted for mating engagement with a second disconnect fitting in flow communication with a source of liquid under pressure;

said one-way valve means allowing entry of said liquid directly into said receptacle from said source of liquid under pressure through said one-way valve element only while said first and second disconnect fittings are engaged and while liquid is flowing through said first disconnect fitting, whereby said receptacle is pressurized during the direct entry of said liquid into said receptacle when said dispensing valve means is closed and said releasable closure is closed;

said one-way valve element preventing backflow of said liquid out of said receptacle.

18. The portable sprayer of claim 17 in which said first and second disconnect fittings comprise first and second quick disconnect fittings.

19. The portable sprayer of claim 18 which additionally includes hand pump means whereby said sprayer can alternatively be pressurized by means of said hand pump means.

20. The portable sprayer of claim 17 in which said receptacle includes a resealable closure which can be opened to allow the insertion of chemicals into said container and then reclosed and resealed to allow pressurization through the introduction of said liquid under pressure.

21. A method for dispensing one of water and a water based solution in a portable sprayer which comprises the steps of:

(a) providing a portable receptacle having 1) a dispensing outlet operably connected to a dispensing valve means which can be opened to dispense water under pressure or closed to seal said receptacle, and 2) a one-way valve separate from said dispensing outlet and dispensing valve means adapted for connection to a garden hose;

(b) closing said dispensing valve means to entrap air within said receptacle;

(c) connecting said one-way valve to a water tap through a garden hose;

(d) introducing water from said water tap into said receptacle through said one-way valve whereby said entrapped air pressurizes said water within said receptacle;

(e) disconnecting said hose from said one-way valve prior to dispensing; and (f) dispensing one of said water and water solution through said receptacle dispensing outlet using said entrapped air as propellant.

22. The method of claim 21 which includes providing said one-way valve with a quick disconnect fitting and providing said garden hose with a quick disconnect fitting.

23. The method of claim 22 which includes additionally providing said receptacle with hand pump means, and repressurizing said receptacle by pumping said hand pump means when the pressure created as a result of introducing said water under pressure into said receptacle has dissipated.

24. A method for dispensing a liquid in a portable sprayer which comprises the steps of:

(a) providing a portable receptacle having a dispensing outlet operably connected to dispensing valve means which can be opened to dispense liquid under pressure or closed to seal said receptacle, a separate one-way valve extending from outwardly of said receptacle directly to the interior thereof and comprising means for allowing entry of said liquid into said receptacle while preventing backflow out of said receptacle, and a resealable closure which can be opened to allow the insertion of chemicals into said container and then reclosed and resealed to allow pressurization through the introduction of said liquid under pressure;

(b) closing said dispensing valve means and said resealable closure means;

(c) connecting said one-way valve to a source of liquid under pressure;

(d) introducing said liquid under pressure into said receptacle through said one-way valve whereby said entrapped air pressurizes said liquid within said receptacle;

(e) disconnecting said source of liquid under pressure from said one-way valve prior to dispensing said liquid; and (f) dispensing said liquid through said receptacle dispensing outlet using said entrapped air as propellant for dispensing said liquid.

25. The method of claim 24 which includes providing said one-way valve with a quick disconnect fitting.

26. The method of claim 25 which includes additionally providing said receptacle with hand pump means, and repressurizing said receptacle by pumping said hand pump means when the pressure created as a result of introducing said water under pressure into said receptacle has dissipated.

27. The method of claim 24 which includes opening said resealable closure and introducing chemicals to be dispensed into said receptacle, followed by closing said resealable closure prior to connecting said one-way valve to said source of liquid under pressure and pressurizing said receptacle.

28. The method of claim 27 in which said source of liquid under pressure comprises tap water.

29. A method for dispensing a liquid in a portable sprayer which comprises the steps of:

(a) providing a portable receptacle having 1) a dispensing outlet operably connected to a dispensing valve means which can be opened to dispense liquid under pressure or closed to seal said receptacle, 2) top, 3)bottom, 4) sidewalls, and 5) a one-way valve separate from said dispensing outlet and dispensing valve means located in said top wall of said receptacle, extending from outside said receptacle directly to the interior thereof and being adapted for connection to a source of liquid under pressure;

(b) closing said dispensing valve means;

(c) connecting said one-way valve to a source of liquid under pressure;

(d) introducing said liquid under pressure directly into said receptacle through said one-way valve whereby said entrapped air pressurizes said liquid within said receptacle;

(e) disconnecting said source of liquid under pressure from said one-way valve prior to dispensing said liquid; and (f) dispensing said liquid through said receptacle dispensing outlet using said entrapped air as propellant for dispensing said liquid.

30. The method of claim 29 which includes providing said one-way valve with a quick disconnect fitting.

31. The method of claim 30 which includes additionally providing said receptacle with hand pump means, and repressurizing said receptacle by pumping said hand pump means when the pressure created as a result of introducing said water under pressure into said receptacle has dissipated.

32. The method of claim 29 in which said source of liquid under pressure comprises tap water.

33. In a portable sprayer for dispensing liquids under pressure, said sprayer comprising a closed receptacle for containing liquids under pressure, said receptacle including a dispensing outlet operably connected to dispensing valve means which can be opened to dispense liquid under pressure or closed to seal said container;

said receptacle including a resealable closure which can be opened to allow the insertion of chemicals into said container and then reclosed and resealed to allow pressurization through the introduction of liquid under pressure;

a one-way valve means for coupling with a source of liquid under pressure separate from said dispensing outlet and dispensing valve means for permitting the flow of liquid only into said receptacle and preventing backflow out of said receptacle;

said one-way valve means allowing entry of said liquid directly into said receptacle from said source of liquid under pressure, whereby said receptacle is pressurized during the direct entry of said liquid into said receptacle when said dispensing valve means is closed and said resealable closure is closed; and said one-way valve means preventing backflow of said liquid out of said receptacle.

34. The sprayer of claim 33 which additionally includes hand pump means mounted in said resealable closure whereby said sprayer can alternately be pressurized by means of said hand pump means.

35. In a portable sprayer for dispensing liquids under pressure, said sprayer comprising a closed receptacle for containing liquids under pressure, said receptacle including a dispensing outlet operably connected to dispensing valve means which can be opened to dispense liquid under pressure or closed to seal said container;

said receptacle including a resealable closure which can be opened to allow the insertion of chemicals into said container and then reclosed and resealed to allow pressurization through the introduction of liquid under pressure;

a one-way valve means for coupling with a source of liquid under pressure separate from said dispensing outlet an dispensing valve means for permitting the flow of liquid only into said receptacle and preventing backflow out of said receptacle;

said one-way valve means allowing entry of said liquid directly into said receptacle from said source of liquid under pressure, whereby said receptacle is pressurized during the direct entry of said liquid into said receptacle when said dispensing valve means is closed and said resealable closure is closed;

said one-way valve means preventing backflow of said liquid out of said receptacle; and dip tube means disposed within the receptacle and coupled with the dispensing outlet for directing liquids under pressure from the receptacle to the dispensing outlet with the pressurization within the receptacle acting upon the top surface of the liquid within the receptacle to force the liquid up through the dip tube to the dispensing outlet.

36. The sprayer of claim 35 which additionally includes hand pump means mounted in said releasable closure whereby said sprayer can alternately be pressurized by means of said hand pump means.

* * * * *